US007503098B2

(12) United States Patent
Stein

(10) Patent No.: US 7,503,098 B2
(45) Date of Patent: Mar. 17, 2009

(54) PIVOTAL AND ROTATIONAL CONNECTION FOR A VACUUM CLEANER TOOL

(75) Inventor: Thomas Stein, Velbert (DE)

(73) Assignee: Stein & Co. GmbH, Velbert (DE)

( * ) Notice: Subject to any disclaimer, the term of this patent is extended or adjusted under 35 U.S.C. 154(b) by 729 days.

(21) Appl. No.: 11/253,158

(22) Filed: Oct. 17, 2005

(65) Prior Publication Data

US 2006/0080803 A1 Apr. 20, 2006

(30) Foreign Application Priority Data

Oct. 16, 2004 (DE) ..... 10 2004 050 471
Oct. 28, 2004 (DE) ..... 10 2004 052 306

(51) Int. Cl.
*A47L 9/02* (2006.01)

(52) U.S. Cl. ..... 15/414; 15/415.1; 285/7

(58) Field of Classification Search ..... 15/414, 15/415.1; 285/7, 273, 274, 282; *A47L 9/02*
See application file for complete search history.

(56) References Cited

U.S. PATENT DOCUMENTS 6,055,703 A * 5/2000 Redding et al. ..... 15/411

FOREIGN PATENT DOCUMENTS

JP 411206654 * 8/1999

* cited by examiner

*Primary Examiner*—David A Redding
(74) *Attorney, Agent, or Firm*—W. F. Fasse; W. G. Fasse

(57) ABSTRACT

A connection arrangement between a vacuum cleaner and a suction tool includes a pivot element pivotably connected to the suction tool and a rotation element rotatably coupled to the pivot element. A suction wand, hose, handle or other vacuum port of the vacuum cleaner is removably connected to a connection end of the rotation element. Coupling ends of the pivot and rotation elements are inserted one in the other, and respectively have circumferential grooves that form a circumferential channel therebetween. Plural partial ring segment elements are received in the circumferential channel to form a connection ring that rotatably secures the pivot and rotation elements. The ring segment elements are inserted into or removed from the channel through a selectively coverable opening in the rotation element or the pivot element. A catch cooperates with a detent to hold a vertically pivoted, rotationally centered rest position of the components.

21 Claims, 3 Drawing Sheets

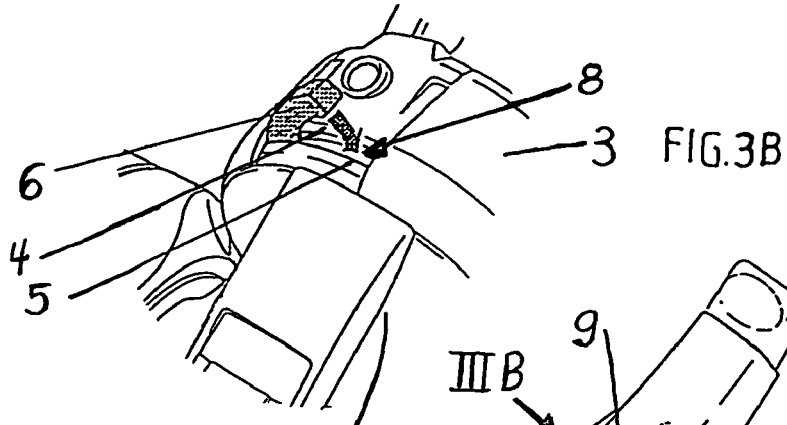
FIG.3B
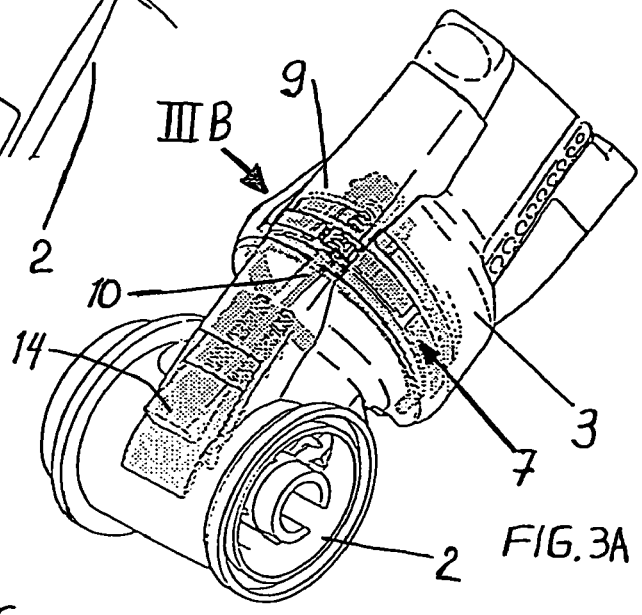
FIG.3A
FIG. 2
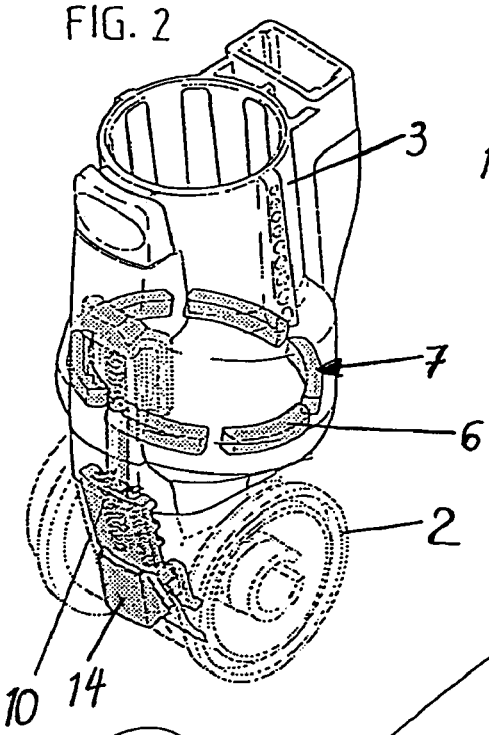
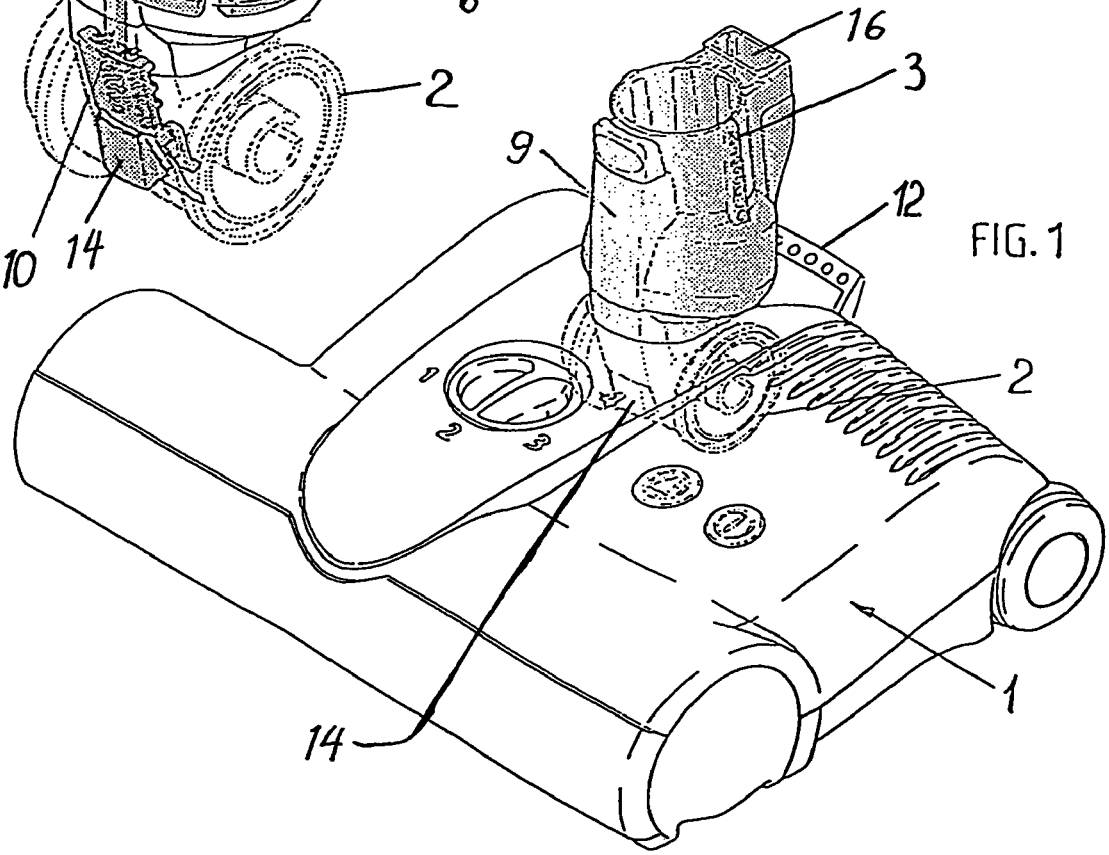
FIG. 1

PIVOTAL AND ROTATIONAL CONNECTION FOR A VACUUM CLEANER TOOL

PRIORITY CLAIM

This application is based on and claims the priorities under 35 U.S.C. §119 of German Patent Application 10 2004 050 471.7, filed on Oct. 16, 2004, and German Patent Application 10 2004 052 306.1, filed on Oct. 28, 2004, the entire disclosures of which are incorporated herein by reference.

FIELD OF THE INVENTION

The invention relates to an arrangement for establishing a pivotal and rotational connection of a vacuum cleaner suction tool to a suction wand, hose, handle, or other suction port of a vacuum cleaner.

BACKGROUND INFORMATION

For convenient handling and flexible or adaptable functionality, it is desirable to connect a vacuum cleaner suction tool in a pivotal and rotational manner relative to the suction wand, hose, handle or other vacuum port connection of a vacuum cleaner. Such a vacuum cleaner suction tool may, for example, be a carpet cleaning power brush or a floor cleaning suction head or any other type of tool, implement, accessory or attachment of a vacuum cleaner. Thus, the terms vacuum cleaner tool and suction tool are used herein generally to designate any known or future developed tool, implement, accessory, or attachment of a vacuum cleaner.

It has been found in practice that it is relatively complicated, costly, and trouble-prone to achieve a pivotal and rotational connection of a suction tool to a vacuum cleaner. The problems in this regard involve several factors. The connection or joint area must be "user friendly" with respect to the connection and disconnection or assembly and disassembly thereof. Also, the connection structure must be robust and durable in order to provide the required long trouble-free operating lifetime in the field of application for floor cleaning tools and the like of vacuum cleaners. Also, the connection structure must be simple and economical, and especially assembled from predominantly plastic components suitable for mass production.

The many different joint or connection structures that have become known in the art have not been sufficiently durable and robust to achieve a long trouble-fee operating life without failure of the plastic components, while achieving the necessary force transmission between the connected suction tool and vacuum cleaner wand, handle or the like.

SUMMARY OF THE INVENTION

In view of the above, it is an object of the invention to provide a pivotal and rotational connection for a vacuum cleaner tool, of the above described general type, but with a simpler construction that achieves a durable connection and rotational and pivotal guidance of the connected parts, while still allowing a simple assembly and disassembly of relatively tightly or closely arranged elements. The invention further aims to avoid or overcome the disadvantages of the prior art, and to achieve additional advantages, as apparent from the present specification.

The above objects have been achieved according to the invention in an arrangement of a suction tool connected to a vacuum cleaner, wherein the invention especially relates to an improved pivotal and rotational connection arrangement for connecting the suction tool to the vacuum cleaner. The connection arrangement includes a pivot element pivotably connected to the suction tool and a rotation element that provides or forms a connection to the vacuum cleaner (e.g. to a suction wand, hose, handle or other suction port of the vacuum cleaner). The rotation element is rotatably connected to the pivot element. It should be understood that the rotational connection does not necessarily enable unlimited or unrestricted continuous rotation of the two elements relative to one another, but rather preferably enables a limited rotational motion through no more than one 360° rotation, but typically less than a complete rotation.

To establish this rotational connection, the pivot element and the rotation element are each provided with a respective circumferential groove around a coupling portion thereof, and the coupling portions of the two elements are inserted and coupled one into the other to bring the respective grooves thereof into alignment with one another so as to form a circumferential channel of the two grooves. To secure the pivot element and the rotation element to each other, while still allowing relative rotation, a plurality of partial ring segment elements are inserted into the circumferential channel through at least one opening in the externally or the internally positioned (pivot or rotation) element. Thereby, the plural partial ring segment elements form a rotation guide and connection ring received in the circumferential channel formed by the grooves. The ring thereby secures the pivot element and the rotation element to each other while allowing relative rotation therebetween. The opening into the channel is preferably coverable or closeable by one or more suitable cover or closure elements.

The inventive pivotal and rotational connection is simple and robust, and can be easily assembled or disassembled simply by inserting or removing the partial ring segment elements through the provided opening into or from the circumferential channel formed by the grooves of the overlapping and inter-engaging coupling ends of the pivot element and the rotation element. The achieved connection ensures relatively small axial play yet smooth free rotation between the connected pivot element and rotation element. The pivot element and rotation element can be economically produced of a plastic, for example by any conventionally known molding processes. The partial ring segment elements forming the guide and connection ring can be produced of a metal, or a plastic, for example a low-friction plastic.

In one advantageous embodiment, the rotation element includes a cylindrical collar or sleeve that extends over a cylindrical collar of sleeve of the pivot element. In other words, the sleeve of the pivot element is inserted into the sleeve of the rotation element. Alternatively, the sleeve of the pivot element can extend over the sleeve of the rotation element, i.e. the sleeve of the rotation element is inserted into the sleeve of the pivot element. In either case, the respective grooves are formed outwardly facing on the outer surface of the inner sleeve, and inwardly facing on the inner surface of the outer sleeve, so as to form the circumferential channel between the inner sleeve and the outer sleeve to receive the guide and connection ring therein.

In order to fix or secure the partial ring segment elements into the circumferential channel formed by the circumferential grooves, at least one of the grooves may be provided with at least one bounded pocket-shaped recess to form a receiver that receives and holds one or more of the partial ring segment elements.

The connection arrangement preferably includes means for fixing or holding a neutral rest position of the arrangement and the associated suction tool and vacuum cleaner. This neutral rest position is preferably defined by a vertical orientation or an (approximately vertical) upright orientation of the pivot element, and a centered rotational position of the rotation element relative to the pivot element. In this rest position, a spring-loaded catch element movably supported in or on the pivot element engages into a counterpart detent or engaging element provided on the rotation element. This engagement of the catch element with the detent serves to hold the rotation and pivot elements in the rest position. Furthermore, the pivot element in its vertical or upright rest position can be locked or blocked against a downward tilting motion thereof, by a locking or fixing element provided for this purpose. Preferably, the locking or fixing element comprises a foot-operated rocker or lever on the suction tool, that selectively engages the pivot element to prevent pivoting thereof out of the vertical or upright rest position.

In order that the opening for inserting the partial ring segment elements into the circumferential channel can be relatively small (spanning less than 90° of the circumference), preferably at least four of the partial ring segment elements are provided to form the guide and connection ring. More preferably, there shall be six of the partial ring segment elements forming the guide and connection ring, so that each partial ring segment element has a length corresponding to a circumferential arc segment of no more than 60°. Thus, the circumferential length of the insertion opening can be correspondingly reduced. Furthermore, to securely maintain the ring segment elements in the circumferential channel, the cover or closure element provided to cover or close the insertion opening is a lockable or fixable cover on the outer sleeve-shaped element, i.e. the sleeve-shaped portion of the outermost one of the pivot element and the rotation element.

A vacuum passage communicates continuously through the interior of the rotation element and the pivot element, to establish a continuous vacuum duct from the vacuum port of the vacuum cleaner (e.g. the vacuum wand, hose, handle or the pipe stub forming the suction port of a handheld vacuum cleaner, or the like) through the connection arrangement into the suction opening of the suction tool. Moreover, if the suction tool is a motorized power brush or the like, requiring an electrical power supply to an electric motor thereof, then electrical conductor lines are further provided through or along the connection arrangement between the vacuum cleaner and the suction tool. In this regard, a pocket-shaped interspace or cavity is preferably provided in and between the pivot element and the rotation element, so as to movably receive the electrical conductor lines therein. Such an arrangement allows the relative (partial) rotation of the rotation element and the pivot element, without disrupting the electrical conductor lines.

In a preferred embodiment, the pivot element and the rotation element forming the connection arrangement remain essentially permanently connected to each other and to the suction tool, such as a floor cleaning tool of the vacuum cleaner, so that the connection arrangement forms a tool unit together with the suction tool itself. In this regard, the term "permanently connected" is merely a relative description, in comparison to the connection of the vacuum cleaner port to the connection end of the rotation element. While the pivot element and the rotation element can be disassembled and disconnected from each other and from the suction tool if necessary (e.g. for cleaning, maintenance, repair or replacement of the connection arrangement parts or of the suction tool), they are intended generally to remain assembled and connected, while the vacuum port of the vacuum cleaner is selectively connected to or removed from the rotation element by the user of the vacuum cleaner. For example, the vacuum cleaner wand, hose, or handle or other component forming the vacuum port is selectively plugged into or removed from the connection end of the rotation element as the user prepares to use a respective selected suction tool. On the other hand, the pivot element and the rotation element preferably each have a beaded edge or rim or collar forming the coupling end provided with the circumferential groove of the respective element, and these collar-shaped coupling ends are rotatably coupled to each other by the guide and connection ring as described herein.

BRIEF DESCRIPTION OF THE DRAWINGS

In order that the invention may be clearly understood, it will now be described in connection with an example embodiment thereof, with reference to the accompanying drawings, wherein:

FIG. 1 is a schematic perspective view, partially illustrated with transparent or ghost features, of a pivotal and rotational connection arrangement including a rotation element and a pivot element connected to a floor cleaning brush tool as an example suction tool of a vacuum cleaner;

FIG. 2 is an enlarged schematic perspective view, with transparent or ghost features, of the pivotal and rotational connection arrangement of FIG. 1 by itself;

FIG. 3A is a schematic perspective view of the arrangement according to FIG. 2, but tilted at a different angle for emphasizing other features thereof;

FIG. 3B is an enlarged perspective view of a detail area portion IIIB of the arrangement of FIG. 3A;

Figure 4B:
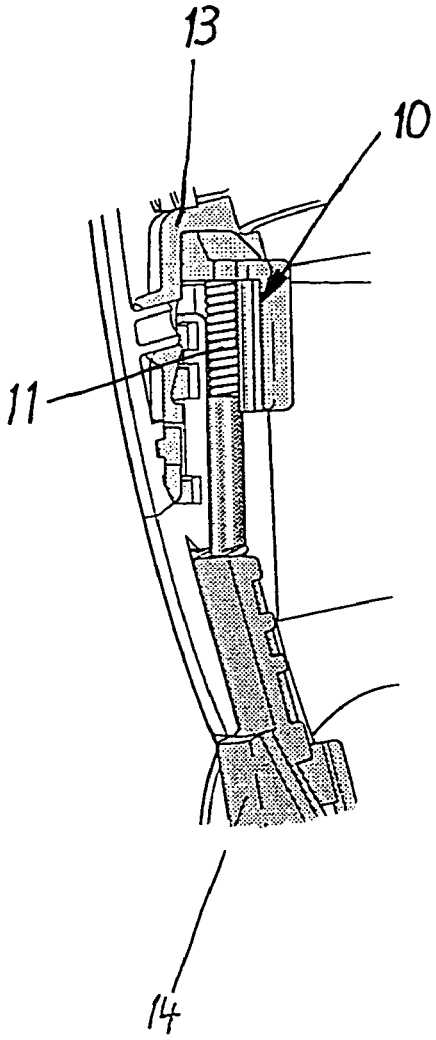
FIG. 4B is an enlarged sectional view of a detail area portion IVB of the arrangement of FIG. 4A.
Figure 4A:
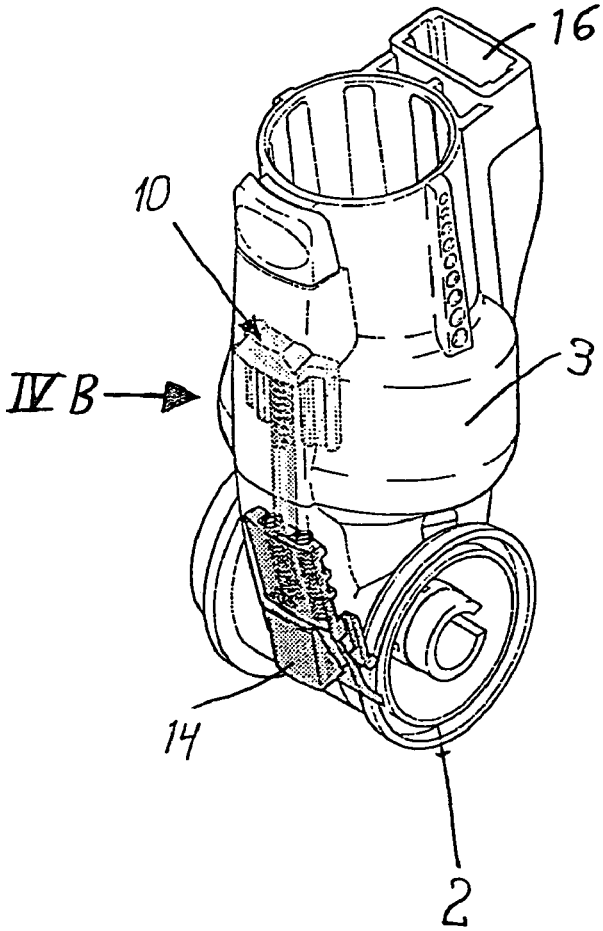
FIG. 4A is a schematic perspective view similar to that of FIG. 2, but emphasizing other features thereof in a ghost illustration.

DETAILED DESCRIPTION OF A PREFERRED EXAMPLE EMBODIMENT AND OF THE BEST MODE OF THE INVENTION

In the illustrated example embodiment (see FIGS. 1 and 5), an inventive pivotal and rotational connection arrangement establishes a pivotal and rotational connection between a suction tool 1 such as a vacuum cleaner floor cleaning brush, and a vacuum port such as the free end of a suction wand 15 of a vacuum cleaner. The pivotal and rotational connection arrangement includes a pivot element 2 that is pivotally connected to the suction tool 1, and a rotation element 3 that is rotatably connected to the pivot element 2. To establish this rotatable connection or coupling between the pivot element 2 and the rotation element 3, respective coupling ends of the elements 2 and 3 are inserted one in the other and are rotatably secured as will be described below. In the illustrated embodiment, the cylindrical sleeve or collar-shaped coupling end of the pivot element 2 is inserted into the cylindrical sleeve or collar-shaped coupling end of the rotation element 3. However, that arrangement may be reversed, namely the coupling end of the rotation element can be inserted into the larger coupling end of the pivot element, in an alternative embodiment.

The connection or coupling of the two elements 2 and 3 to each other, so as to allow free rotation yet secure the elements axially with minimal free play, is achieved as follows according to the invention. The coupling ends of the rotation element 3 and the pivot element 2 are respectively provided with circumferential grooves 4 and 5. In the illustrated embodiment with the coupling end of the pivot element 2 inserted into the coupling end of the rotation element 3, the groove 4 is an inwardly facing groove on an inner surface of the coupling end of the rotation element 3, while the groove 5 is an outwardly facing groove on an outer surface of the coupling end of the pivot element 2. When the coupling ends are inserted one into the other, these grooves 4 and 5 are aligned so that they together form a circumferential channel between the coupled ends of the pivot element 2 and the rotation element 3.

A plurality of partial ring segment elements 6, and preferably at least four or especially six of these ring segment elements 6, are received in the circumferential channel formed by the grooves 4 and 5. Thereby, the ring segment elements 6 together form an interrupted or discontinuous guide and connection ring 7 that secures the elements 2 and 3 against axial decoupling thereof, while allowing relative rotation thereof. To achieve this secured coupling, the partial ring segment elements 6 are inserted into the circumferential channel through at least one opening 8 provided in the outermost one of the elements, e.g. in the rotation element 3, in this illustrated embodiment, but alternatively in the inner one of the elements. This opening 8 is selectively closed or opened by a fixable or lockable cover or closure element 9. Thus, it is quite simple to assemble or disassemble this secured rotational coupling whenever necessary, for example for the original manufacturing and installation, or for later maintenance, repair, or replacement.

When the rotation element 3 is in a prescribed centered rotational position, and the pivot element 2 is in a vertical position or generally upright orientation, this defined rest position can be fixed or held. To achieve this, a spring-loaded catch element 10 movably supported in the pivot element 2 engages into a detent 13 provided in the rotation element 3, in order to fix or hold the rotational position of the rotation element 3 relative to the pivot element 2 and thereby maintain the centered rest position. Furthermore, a locking or fixing element 12 provided on the suction tool 1 engages the pivot element 2 when the pivot element 2 is in its upright rest position, so as to lock or fix the pivot element 2 against pivoting out of this upright rest position. The locking or fixing element 12 may comprise a foot-operated pedal rocker or lever, which can be depressed by the foot of a user of the vacuum cleaner, in order to disengage the rest position lock and allow the pivot element 2 to be pivoted out of the upright rest position.

Further in this regard, the spring-loaded catch element 10 that secures the rotation element 3 against rotation out of the centered rotational rest position is preferably further positively operated by a slider 14 so as positively engage the detent 13. In this regard, the slider 14 is only actuated in the upright rest position of the pivot element 2. Namely, when the pivot element 2 is pivoted upwardly into its rest position, the slider 14 contacts a part of the suction tool 1, so that the pivoting motion of the pivot element 2 causes the slider 14 to slide relatively upwardly, thereby compressing the biasing spring 11 and positively engaging the catch element 10 with the detent 13. On the other hand, when the pivot element 2 is pivoted out of its upright rest position, the slider 14 slides downwardly, thereby decompressing the biasing spring 11, such that the catch element 10 is engaged with the detent only by a resilient spring bias applied by the spring 11. In that condition, a user can apply a rotating force to the rotation element 3, thereby overcoming the spring-biased engagement of the catch element 10 with the detent 13, so as to allow rotation of the rotation element 3 out of the centered rotational rest position thereof.

Figure 5:
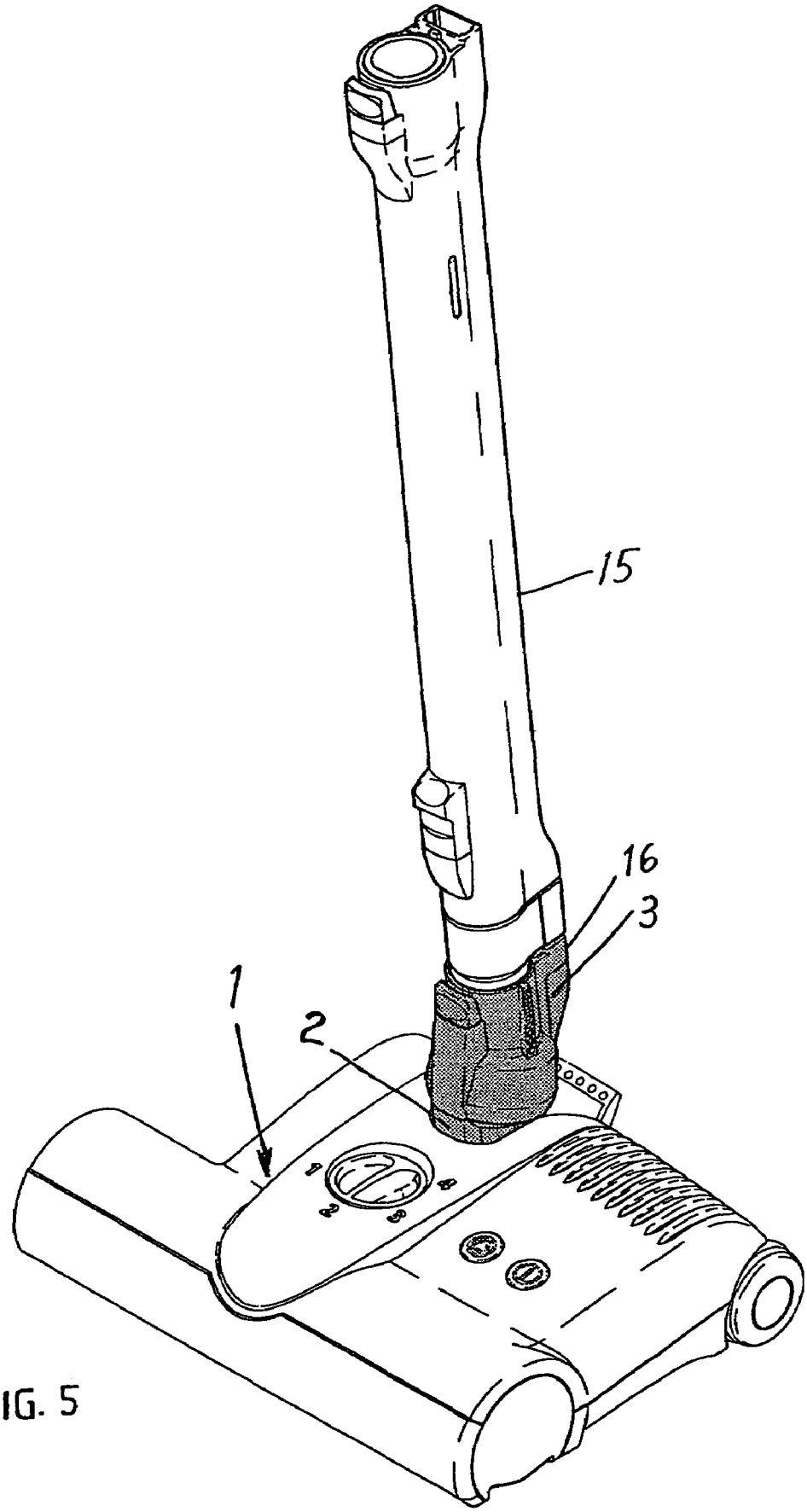
FIG. 5 is a schematic perspective overview of a vacuum cleaner suction wand as an example vacuum port of a vacuum cleaner plugged into a connection end of the rotation element of the pivotal and rotational connection arrangement.

FIG. 5 shows the rotation element 3 and the pivot element 2 forming the inventive connection arrangement between the vacuum cleaner wand 15 and the suction tool 1. In the preferred embodiment, the connection arrangement including elements 2 and 3 remains essentially permanently connected to the suction tool 1 to form a unit therewith. On the other hand, a connection stub at the end of the vacuum cleaner wand 15 (or any other similar connection stub of a vacuum cleaner hose, handle, handheld vacuum cleaner unit, or some other vacuum port of the vacuum cleaner) is plugged into or removed from the connection end of the rotation element 3 by a user as needed to connect or disconnect this selected tool unit to or from the vacuum cleaner. Thereby, a vacuum connection through the continuous interior vacuum passage, as well as an electrical connection is established through the inventive pivotal and rotational connection arrangement. For the electrical connection, flexible electrical conductors extend through a pocket-shaped recess or cavity 16 that extends along the elements 2 and 3, and that has a sufficient circumferential extent or free play space relative to the conductors to allow the (limited) relative rotation of the elements 2 and 3 as described above.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a vacuum cleaner combination including a vacuum cleaner, a suction tool and a pivotal and rotational connection arrangement between a suction opening of said suction tool and a vacuum port of said vacuum cleaner, an improvement wherein said pivotal and rotational connection arrangement comprises:

a pivot element pivotably connected to said suction tool, wherein a coupling end of said pivot element has a first circumferential groove provided therein;

a rotation element having a connection end that is removably connectable to said vacuum port of said vacuum cleaner, and a coupling end with a second circumferential groove provided therein; and a plurality of partial ring segment elements;

wherein:

said coupling ends are coupled together, with one of said coupling ends inserted in the other, so that said first and second circumferential grooves align and face one another to form of said grooves a circumferential channel;

said partial ring segment elements are received in said circumferential channel to form of said partial ring segment elements a guide and connection ring that connects said pivot element and said rotation element with one another so as to allow relative rotation thereof;

said pivot element or said rotation element has at least one opening that communicates into said circumferential channel, through which opening said partial ring segment elements can be inserted into and removed from said circumferential channel; and said pivot element and said rotation element form and enclose therein a continuous vacuum passage between said suction opening of said suction tool and said vacuum port of said vacuum cleaner.

2. The improvement in the vacuum cleaner combination according to claim 1, wherein said vacuum cleaner includes a suction wand, hose, or handle, said vacuum port is provided at an end of said wand, hose or handle, and said end of said wand, hose or handle can be plugged into said connection end of said rotation element.

3. The improvement in the vacuum cleaner combination according to claim 1, wherein said pivot element is permanently connected to said suction tool, and said rotation element is permanently connected to said pivot element, so that said pivot element and said rotation element together with said suction tool form a tool unit.

4. The improvement in the vacuum cleaner combination according to claim 1, further comprising one or more closure elements movably arranged to selectively close and open said at least one opening.

5. The improvement in the vacuum cleaner combination according to claim 4, wherein said closure element is a selectively lockable cover arranged on said pivot element or said rotation element having said at least one opening.

6. The improvement in the vacuum cleaner combination according to claim 1, wherein said plurality comprises at least four of said partial ring segment elements.

7. The improvement in the vacuum cleaner combination according to claim 1, wherein said plurality comprises six of said partial ring segment elements.

8. The improvement in the vacuum cleaner combination according to claim 1, wherein each said coupling end of said pivot element and of said rotation element respectively is a cylindrical collar-shaped coupling end.

9. The improvement in the vacuum cleaner combination according to claim 1, wherein each said coupling end of said pivot element and of said rotation element respectively is a cylindrical sleeve-shaped coupling end, said coupling end of said pivot element is inserted into said coupling end of said rotation element, and said coupling end of said rotation element has said at least one opening.

10. The improvement in the vacuum cleaner combination according to claim 1, wherein each said coupling end of said pivot element and of said rotation element respectively is a cylindrical sleeve-shaped coupling end, said coupling end of said rotation element is inserted into said coupling end of said pivot element, and said coupling end of said pivot element has said at least one opening.

11. The improvement in the vacuum cleaner combination according to claim 1, wherein one of said circumferential grooves has at least one bounded pocket-shaped recess in which at least one of said partial ring segment elements is fixed.

12. The improvement in the vacuum cleaner combination according to claim 1, further comprising a detent provided on said rotation element, and a spring-loaded catch element provided on said pivot element, wherein said catch element engages said detent when said rotation element is at a centered rotation position relative to said pivot element.

13. The improvement in the vacuum cleaner combination according to claim 12, further comprising a slider slidably arranged on said pivot element so that said slider contacts and is slidingly pushed by a part of said suction tool when said pivot element is pivoted to an upright position relative to said suction tool, and wherein said slider is coupled to said catch element so that said slider pushes said catch element positively into engagement with said detent when said slider is slidingly pushed by said part of said suction tool.

14. The improvement in the vacuum cleaner combination according to claim 1, further comprising a fixing element that selectively engages said pivot element in an upright position of said pivot element relative to said suction tool, so as to fix said pivot element in said upright position.

15. The improvement in the vacuum cleaner combination according to claim 14, wherein said fixing element comprises a foot-operable rocker lever arranged on said suction tool.

16. The improvement in the vacuum cleaner combination according to claim 1, wherein a pocket-shaped interspace cavity is formed in and between said pivot element and said rotation element, and further comprising electrical conductor lines extending through said pocket-shaped interspace cavity.

17. The improvement in the vacuum cleaner combination according to claim 1, wherein said at least one opening that communicates into said circumferential channel is provided on a radially outer one of said pivot element or said rotation element and is accessible externally.

18. The improvement in the vacuum cleaner combination according to claim 1, wherein said at least one opening that communicates into said circumferential channel is provided on a radially inner one of said pivot element or said rotation element and is accessible internally from inside said vacuum passage.

19. The improvement in the vacuum cleaner combination according to claim 1, wherein said coupling end of said pivot element is inserted in said coupling end of said rotation element.

20. The improvement in the vacuum cleaner combination according to claim 1, wherein said coupling end of said rotation element is inserted in said coupling end of said pivot element.

21. The improvement in the vacuum cleaner combination according to claim 1, wherein said vacuum cleaner is a hand-held vacuum cleaner unit that includes a tool connection pipe stub forming said vacuum port, and said pipe stub can be plugged into said connection end of said rotation element.

* * * * *